US007377804B2

(12) United States Patent
Lin

(10) Patent No.: US 7,377,804 B2
(45) Date of Patent: May 27, 2008

(54) CONNECTOR FOR ELECTRONICALLY CONNECTING A CABLE AND A PRINTED CIRCUIT BOARD

(75) Inventor: Tzu-Chih Lin, Jhudong Township, Hsinchu County (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/458,757

(22) Filed: Jul. 20, 2006

(65) Prior Publication Data

US 2007/0232127 A1 Oct. 4, 2007

(30) Foreign Application Priority Data

Mar. 29, 2006 (TW) ..... 95111064 A

(51) Int. Cl.
*H01R 12/24* (2006.01)

(52) U.S. Cl. ..... 439/499

(58) Field of Classification Search ..... 439/492, 439/493, 329, 499, 367, 67, 74
See application file for complete search history.

(56) References Cited

U.S. PATENT DOCUMENTS 4,640,562 A * 2/1987 Shoemaker ..... 439/77
4,770,645 A * 9/1988 Antes ..... 439/329
5,924,875 A * 7/1999 Tighe et al. ..... 439/74
6,371,797 B1 4/2002 Kikuchi et al.
6,960,094 B2 * 11/2005 Tomonari et al. ..... 439/329

* cited by examiner

*Primary Examiner*—Chandrika Prasad
(74) *Attorney, Agent, or Firm*—Workman Nydegger

(57) ABSTRACT

An electrical connector structure is provided. The electrical connector structure is applicable in an electronic device having a printed circuit board (PCB), and is electrically connected with the PCB via a flexible flat cable (FFC). The electrical connector structure includes a plurality of electrical terminals disposed on the PCB, and a sleeve lid disposed at the position corresponding to the electrical terminals. The sleeve lid is formed with an opening. The FFC extends into the opening to contact the electrical terminals. A blade spring disposed on the surface of the sleeve lid is used to press the FFC, making its contact with the electrical terminals compact.

10 Claims, 6 Drawing Sheets

CONNECTOR FOR ELECTRONICALLY CONNECTING A CABLE AND A PRINTED CIRCUIT BOARD

CROSS-REFERENCE TO RELATED APPLICATIONS

This non-provisional application claims priority under 35 U.S.C. §119(a) on Patent Application No(s). 095111064 filed in Taiwan, R.O.C. on Mar. 29, 2006 the entire contents of which are hereby incorporated by reference.

BACKGROUND OF THE INVENTION

1. Field of Invention

The present invention relates to an electrical connector structure, and more particularly, to an electrical connector structure applicable in a flexible printed circuit board or a flexible flat cable.

2. Related Art

A connector is an important component for connecting circuits or signals between electronic apparatuses. The application field of the connector is quite wide. Industries such as computer, communication, and data transmission, even medical treatment, industrial electronic measuring instruments and automobiles all need to use connectors. However, with the trend of development of smaller and thinner electronic apparatuses, a flexible printed circuit (FPC) board and flexible flat cable (FFC) are widely used in electronic apparatuses such as mobile phones, keyboards, hard disk drivers, fax machines and other multimedia apparatuses. Thus the FPC/FFC electrical connector used to connect the flexible printed circuit board and the motherboard or connect the flexible flat cable and the motherboard is correspondingly applied in the above-mentioned electronic apparatuses. Currently, in the field of the FPC/FFC electrical connector, the electrical connector used for electrically connecting the FPC board mainly includes an insulating body, a plurality of terminals accommodated in the insulating body, and a card board moveably assembled to the insulating body. When the FPC board is inserted into the insulating body, the card board presses against the FPC board, so that the FPC board is electrically contacted with the plurality of terminals.

As disclosed in U.S. patent publication No. U.S. Pat. No. 6,371,797, an electrical connector for electrically connecting a FPC circuit board is provided. As shown in FIG. 1 of the patent No. U.S. Pat. No. 6,371,797, a pair of arm receptacles 26 is formed at the external side walls of an insulator 1, which has a clamping slot disposed thereon. A handling portion 11 can be moved in the clamping slot via the arm 23, so that a space for inserting is left between the handling portion and the insulating body. When the FPC board is inserted, the handling portion 11 is pressed into a socket of the insulating body 1. Here, a pressing part of the handling portion 11 presses the FPC board, so that its conductive part closely contacts with the plurality of terminals to form the electrical connection between the FPC board and the electrical connector.

As shown in FIG. 2, a connector 20*a* is electrically connected to a FPC board 30*a*, and the connector 20*a* includes a plug terminal 23*a* and a slot 24*a*. The slot 24*a* is provided for inserting a FFC 40*a*. The FFC 40*a* is electrically connected with the FPC board 30*a* via the connector 20*a*.

However, the electrical connector stricture establishing the electrical connection via this indirect manner has a highly complicated structure and is hard to be assembled. In addition, when the material department is performing an incoming material operation, it should be considered that, when a single electrical connector is used with other electronic devices, the complexity in processing is caused. Also, the price of the electrical connector is an important factor influencing the incoming material operation. For example, with the increase of the number of plug terminals in the electrical connector, the price of the electrical connector also becomes higher. Meanwhile, in order to connect the single electrical connector to different electronic devices, its volume and occupied space is quite large, which is not suitable for being used in the current electronic devices required to be flat.

SUMMARY OF THE INVENTION

In view of the prior art disclosed above, the object of the present invention is to provide an electrical connector structure with a simple structure that can reduce the incoming material cost and accord with the requirement for flatness and make different electronic devices achieve the effect of close contact.

The electrical connector structure according to the present invention is applicable in the electronic device having a printed circuit board (PCB). The electrical connector structure comprises a plurality of electrical terminals and a sleeve lid, wherein the plurality of electrical terminals is disposed on the PCB, and the sleeve lid is disposed on the PCB corresponding to the position of the electrical terminals. The sleeve lid has a lid body and a positioning part extending from an end of the lid body. The lid body has an opening, so that an accommodation space is formed by the lid body and the PCB together, and one side of the opening has a blade spring that may extend into the accommodation space.

The electrical connector stricture disclosed according to the present invention may reduce the number of devices in the prior art, so as to simplify the forming and assembling processes of the structure. The price of the electrical connector does not increase though the number of electrical terminals is increased, and the incoming material cost is also reduced. With the accommodation space provided by the electrical connector structure, an area is provided for the FFC and the PCB to contact directly, and the contact area can be flattened, such that not too big space is occupied and its volume is reduced. In addition, the electrical connector structure assisted with the pressing positioning scheme of the blade spring may indeed achieve the effect of close contact of the FFC and the PCB, and the disadvantage of a loose contact does not occur.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow for illustration only, and which thus is not limitative of the present invention, and wherein.

DETAILED DESCRIPTION OF THE INVENTION

The present invention provides an electrical connector structure, which is applicable in, but not limited to, FPC boards, FFCs, and the like. For example, the structures for establishing electrical connections for individual electronic devices and a combination thereof may also use the technology disclosed in the present invention. In the following detailed illustration of the present invention, the FPC board and the FFC are used as the application embodiment of the present invention.

Figure 1:
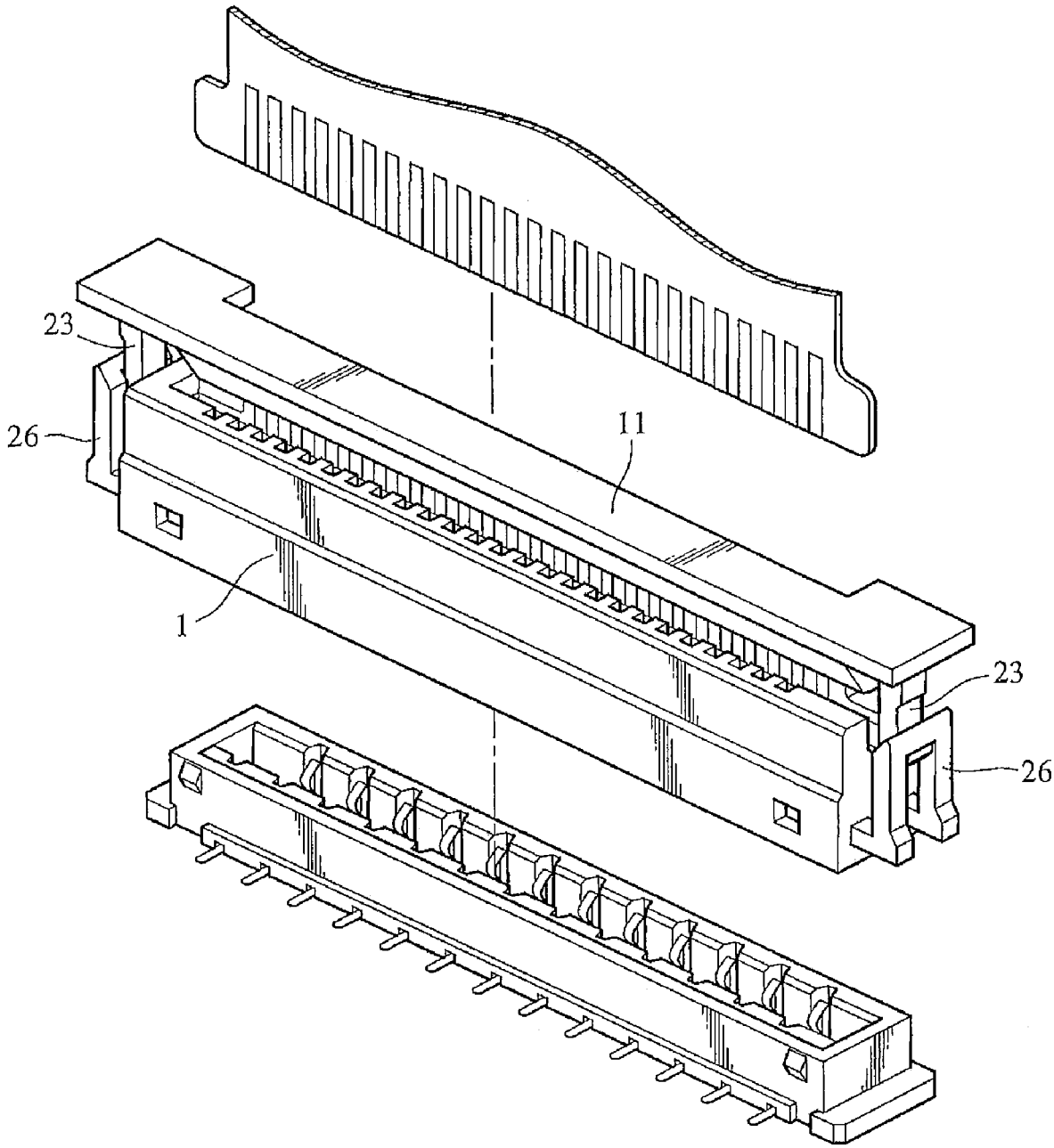
FIG.1 (PRIOR ART)
FIG. 1 is an exploded perspective view showing a conventional connector.
Figure 2:
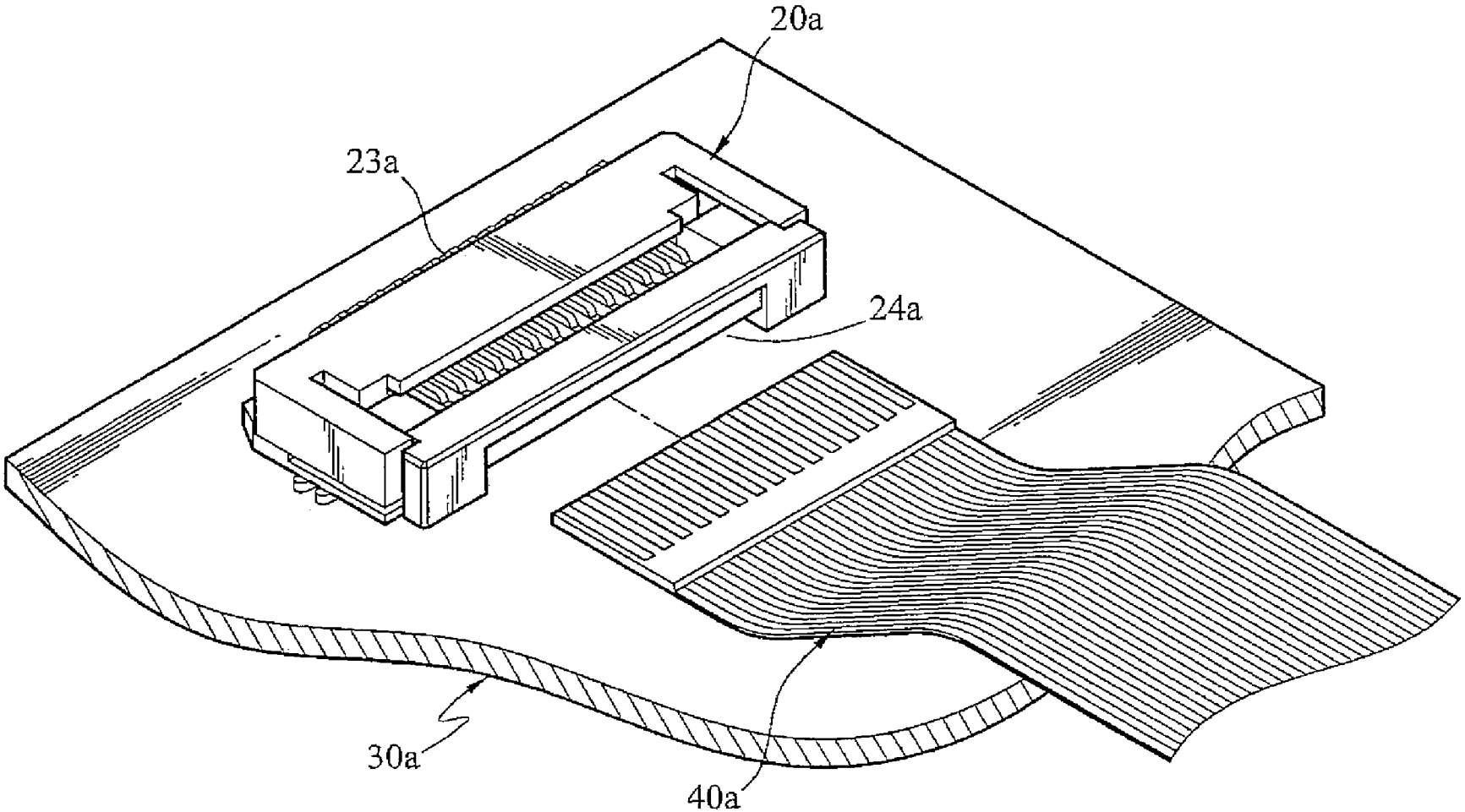
FIG.2 (PRIOR ART)
FIG. 2 is a use state diagram of a conventional electrical connector.
Figure 3A:
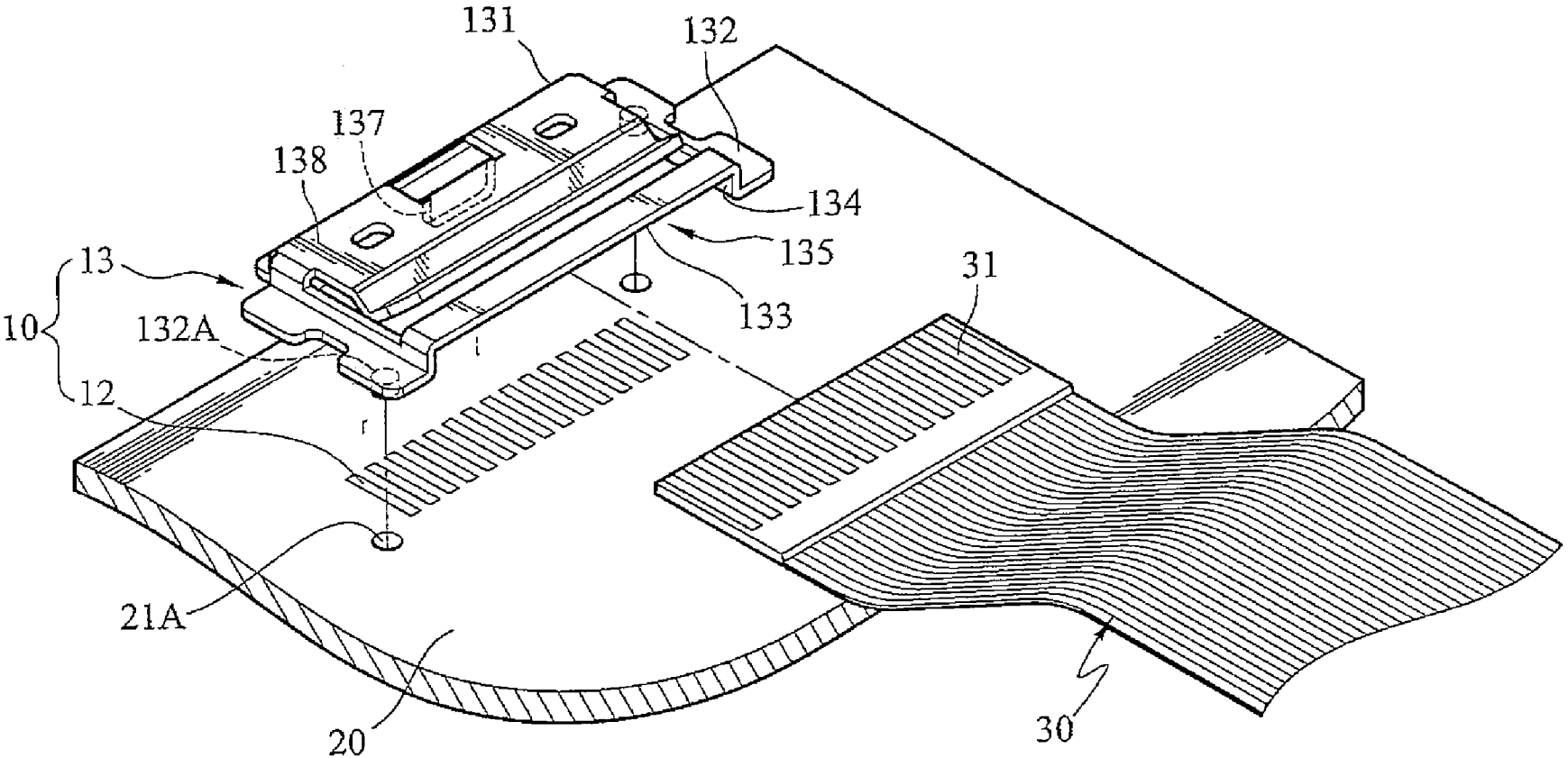
FIG. 3A is an exploded view of the structure of the present invention.
Figure 3B:
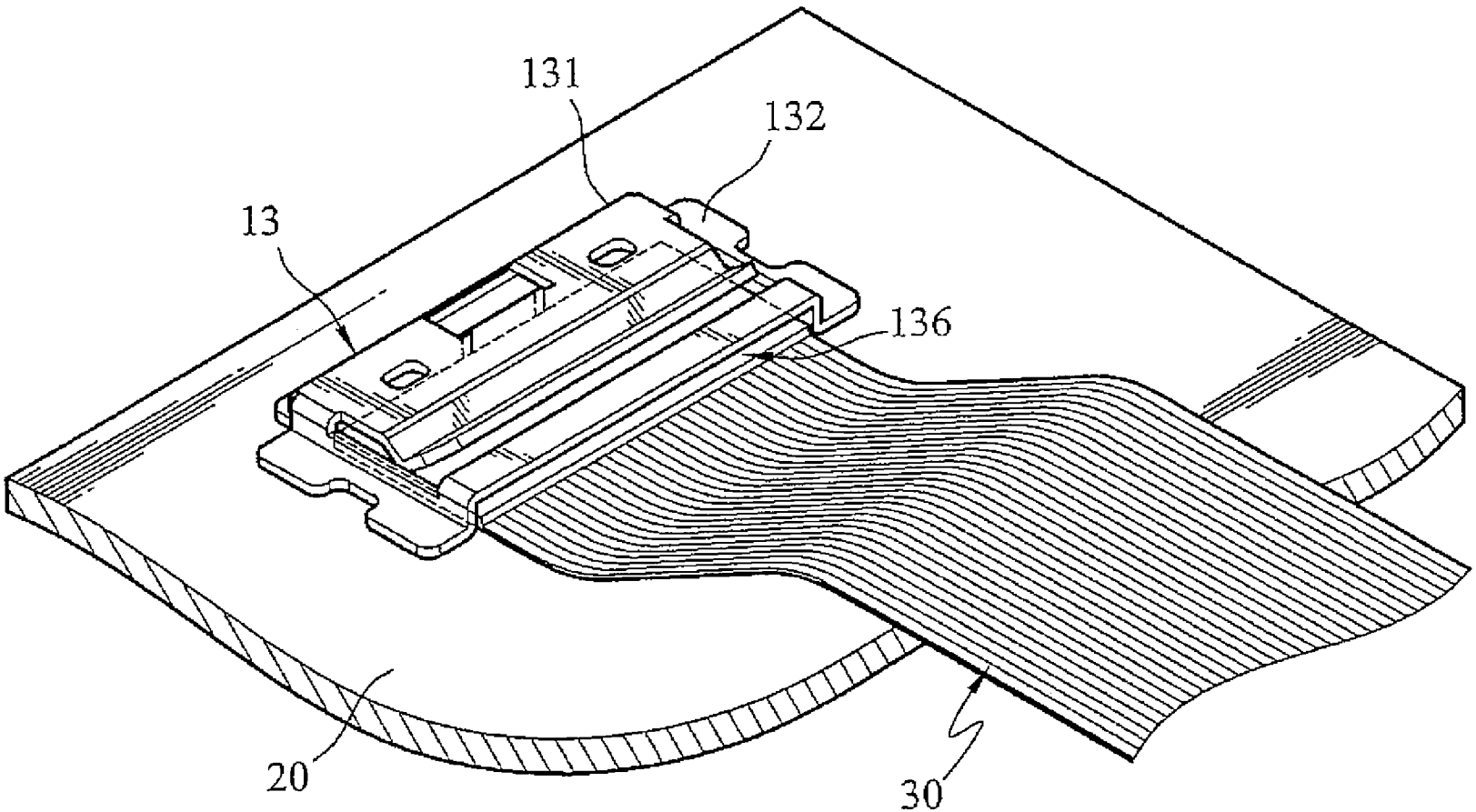
FIG. 3B is a use state diagram of the present invention.
Figure 4:
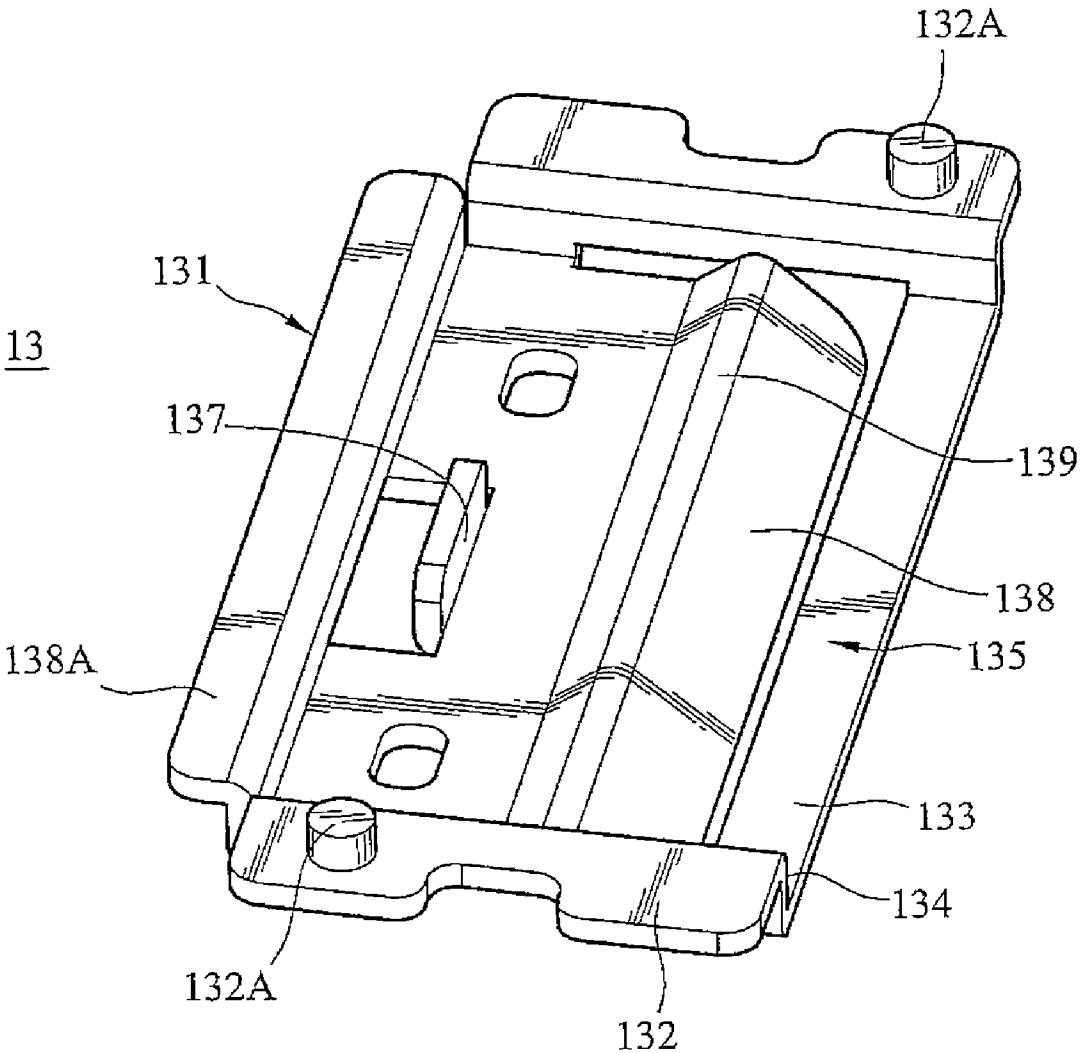
FIG. 4 is a bottom view of the sleeve lid of the present invention.

As shown in FIGS. 3A and 3B, the electrical connector structure 10 comprises a plurality of electrical terminals 12 and a sleeve lid 13. The plurality of electrical terminals 12 of the electrical connector structure 10 is nakedly disposed on a PCB 20. The sleeve lid 13 has a lid body 131 and a positioning part 132 extending from an end of the lid body 131. The lid body 131 further has a top wall 133 and a side wall 134, and the sleeve lid 13 has an opening 135, therefore, with an open space formed by enclosing the top wall 133 and the side wall 134, an accommodation space 136 may be formed by the sleeve lid 13 together with the PCB 20 (as shown in FIG. 3B). A blade spring 138 is disposed and extends along the surface of the lid body 131 at one side of the opening 135.

Figure 5:
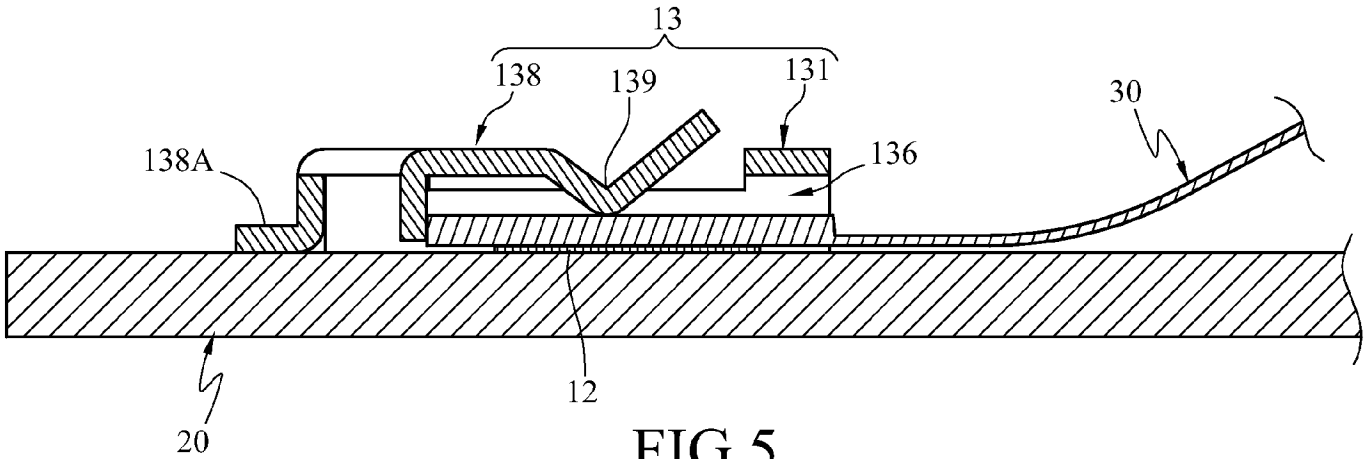
FIG. 5 is a sectional view of a plugged FFC of the present invention.

As shown in FIGS. 3A and 5, the sleeve lid 13 is disposed on the PCB 20 corresponding to the position of the plurality of electrical terminals 12. The sleeve lid 13 is disposed on the PCB 20 by a positioning part 132. The positioning part 132 further has a positioning bump 132A, and the PCB 20 has a positioning hole 21A at the position corresponding to the positioning bump 132A. In the same way, if the positioning part 132 further has a positioning hole, the PCB 20 must have a positioning bump at the position corresponding to the positioning hole. Further, the sleeve lid 13 may also be soldered on the PCB 20 with the positioning part 132. A fixing part 138A is formed on one end of the blade spring 138 (as shown in FIG. 5), by which the end is fixed on the PCB 20 together with the sleeve lid 13. The other end of the blade spring 138 is in an arc state and bends upwards relative to the sleeve lid 13. The blade spring 138 further has a pressing part 139 at the position corresponding to the electrical terminals 12, and the blade spring 138 extends into the accommodation space 136 with the pressing part 139.

As shown in FIGS. 3A, 3B, 4 and 5, when the electrical connector structure 10 is applied to the FFC 30 of the electronic device, an electrical contact part 31 of the FFC 30 is made to move towards the plurality of electrical terminals 12 on the PCB 20, so as to achieve the state of substantial contact, wherein, a solder joint (e.g., solder) is further disposed at the place adjacent to the electrical terminals 12, so as to increase the electrical contact surface between the electrical terminals 12 and the FFC 30. The top wall 133 covers the top part of the electrical terminals 12, and the side wall 134 covers the side part of the electrical terminals 12. In the process of moving the FFC 30 towards the electrical terminals 12, the FFC 30 moves aligned with the electrical terminals 12, and extends into the opening 135 to reach the accommodation space 136, thus substantially contacting the electrical terminals 12 in the accommodation space 136. As the pressing part 139 of the blade spring 138 extends into the accommodation space 136, the FFC 30 contacts the pressing part 139. When the FFC 30 is pressed by the pressing part 139, the pressing force continuously presses the electrical contact part 31 of the FFC 30, so as to closely contact the FFC 30 with the electrical terminals 12. Further, a stop part 137 is disposed on the lid body 131 relative to the moving direction of the FFC 30 (as shown in FIG. 3A), and the stop part 137 is located adjacent to the stop position of the plurality of electrical terminals 12, such that the FFC 30 may only move to the stop position when the FFC 30 extends into the accommodation space 136.

Figure 6:
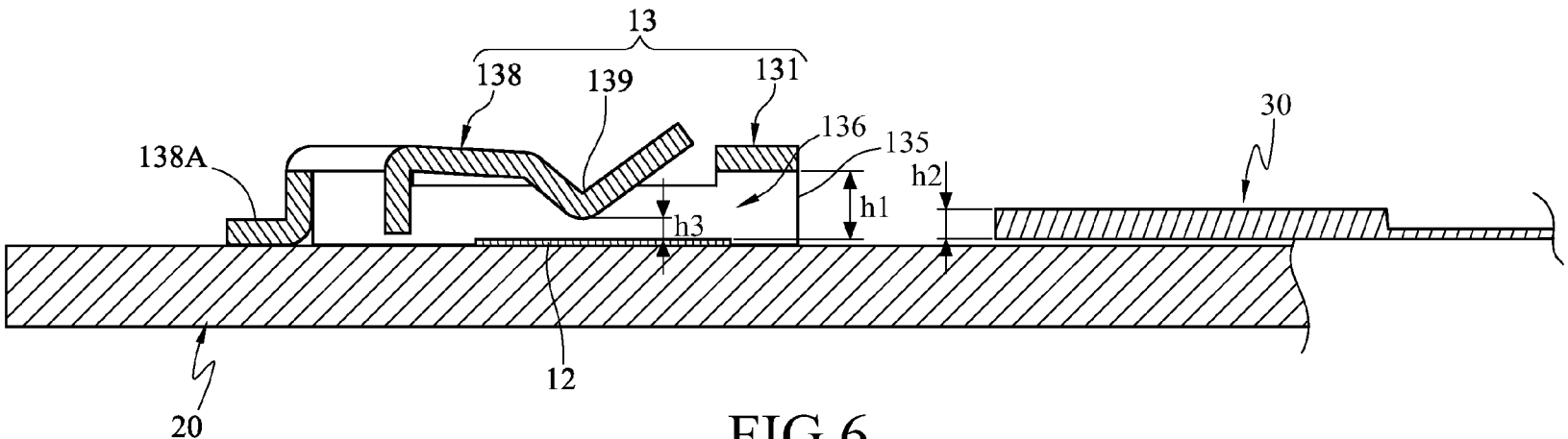
FIG. 6 is a schematic view of the pressing principle of using a blade spring of the present invention.

As shown in FIG. 6, the height between the opening 135 and an upper surface of the electrical terminals 12 is defined as a first height h1, the height of the FFC 30 is defined as a second height h2, and the height between a lower end of the pressing part 139 and an upper surface of the electrical terminals 12 is defined as a third height h3. In the moving process of the FFC 30, the width of the opening 135 must be larger than the width of the FFC 30, and the first height h1 also must be larger than the second height h2 of the FFC 30, thus the FFC 30 may pass through the opening 135. In addition, the pressing part 139 extends into the accommodation space 136, so that there is a relative change of height in the accommodation space 136. The third height h3 between the lower end of the pressing part 139 and the upper surface of the electrical terminals 12 is smaller than the second height h2. Therefore, when the FFC 30 passes through the pressing part 139 to the stop position and stops its movement, as shown in FIG. 5, the pressing part 139 is biased by the blade spring 138 to provide a downward pressing force to the FFC 30, so as to make the contact between the electrical terminals 12 nakedly disposed on the PCB 20 and the FFC 30 more compact.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector for electrically connecting a cable and a printed circuit board, comprising:

a plurality of electrical terminals disposed on the PCB; and a sleeve lid, disposed on the PCB corresponding to the position of the electrical terminals, having a lid body and a positioning part extending from an end of the lid body; wherein the lid body has an opening, an accommodation space formed by lid body and the PCB to accommodate the cable, a stop part located adjacent to a stop position of the electrical terminals to stop the cable at the stop position, and a blade spring disposed on the lid body at one side of the opening and extending into the accommodation space to press the cable on the electrical terminals.

2. The connector for electrically connecting a cable and a printed circuit board as claimed in claim 1, wherein the electrical terminals further have a solder joint, for increasing the electrical contact surface of the electrical terminals.

3. The connector for electrically connecting a cable and a printed circuit board as claimed in claim 2, wherein the solder joint is solder.

4. The connector for electrically connecting a cable and a printed circuit board as claimed in claim 1, wherein the lid body further comprises a top wall for covering the top part of the electrical terminals and a side wall for covering the side part of the electrical terminals.

5. The connector for electrically connecting a cable and a printed circuit board as claimed in claim 4, wherein the accommodation space is formed by enclosing the top wall and the side wall.

6. The connector for electrically connecting a cable and a printed circuit board as claimed in claim 1, wherein the sleeve lid is disposed on the PCB by the positioning part.

7. The connector for electrically connecting a cable and a printed circuit board as claimed in claim 1, wherein the positioning part has a positioning bump, and the PCB has a positioning hole correspondingly.

8. The connector for electrically connecting a cable and a printed circuit board as claimed in claim 1, wherein the positioning part has a positioning hole, and the PCB has a positioning bump correspondingly.

9. The connector for electrically connecting a cable and a printed circuit board as claimed in claim 1, wherein one end of the blade spring has a fixing part, by which the end is fixed on the PCB together with the sleeve lid, and the other end forms an arc angle with the sleeve lid.

10. The connector for electrically connecting a cable and a printed circuit board as claimed in claim 1, wherein the blade spring further has a pressing part at a position corresponding to the electrical terminals, the electronic device extends into the opening with a cable to reach the accommodation space, and the pressing part presses the cable such that the cable closely contacts the electrical terminals.

* * * * *